United States Patent [19]

Tukui

[11] 4,171,847

[45] Oct. 23, 1979

[54] FOLDABLE BABY WALKER

[75] Inventor: Motoichi Tukui, Tokyo, Japan

[73] Assignee: Tukui Seisakusho Co., Ltd., Tokyo, Japan

[21] Appl. No.: 885,817

[22] Filed: Mar. 13, 1978

[30] Foreign Application Priority Data

Nov. 7, 1977 [JP] Japan ..... 52-149268[U]

[51] Int. Cl.[2] ..... A47D 13/04

[52] U.S. Cl. ..... 297/5; 297/136; 248/188; 16/143

[58] Field of Search ..... 297/5, 6, 136; 280/87.02 R, 87.02 W, 87.05; 16/143; 108/131, 132, 133; 403/91, 92, 100

[56] References Cited

U.S. PATENT DOCUMENTS

| | | | |
|---|---|---|---|
| 1,031,851 | 7/1912 | January | 16/143 |
| 1,646,175 | 10/1927 | Thiede | 16/143 |
| 2,029,484 | 2/1936 | Howard et al. | 403/100 |
| 2,215,093 | 9/1940 | Boardman | 248/188 |
| 3,026,161 | 3/1962 | Mickelson | 403/92 X |
| 3,504,927 | 4/1970 | Seki | 297/5 |

FOREIGN PATENT DOCUMENTS

| | | | |
|---|---|---|---|
| 2161204 | 6/1973 | Fed. Rep. of Germany | 297/5 |

*Primary Examiner*—Roy D. Frazier
*Assistant Examiner*—Peter A. Aschenbrenner

[57] ABSTRACT

A foldable baby walker including a body carrier, an annular base frame and three or more support legs collapsibly bridged therebetween is disclosed.

4 Claims, 8 Drawing Figures

FOLDABLE BABY WALKER

BACKGROUND OF THE INVENTION

1. Field of the Invention

This invention relates to an improved baby walker and more particularly to a foldable baby walker for training the baby to walk.

2. Description of the Prior Art

Baby walkers heretofore used are generally not foldable, and therefore, are inconvenient to carry or to store due to their bulkiness.

SUMMARY OF THE INVENTION

A general object of the invention is to provide a baby walker which is foldable by a simple and convenient operation.

In accordance with the present invention, there is provided a foldable baby walker which comprises a body carrier, an annular base frame having caster rollers and three or more support legs which are collapsibly but inseparably bridged between the body carrier and the annular base frame, each support leg being loosely pivoted at its lower end to the annular base frame and at its upper end to the body carrier through a locking means secured to the body carrier and having a slider adapted to urge the leg into locking position.

The locking means is typically comprised of a bracket secured to a body carrier and provided with an inclined slot for receiving a slider which urges and locks the leg member.

In another embodiment of the invention, the locking means comprises a substantially conical semi-sleeve bracket with a ring encircling the same to which an upper end of the support leg is pivoted. When the upper end of the support leg is aligned with the bracket, the ring slides down until it is engaged with and stopped by the broadened circumferential wall of the semi-sleeve bracket so that the upper end of the support leg is clamped by the ring.

In a further embodiment of the invention, the locking means comprises a bracket which on one side is provided with a offset slot for receiving a slider adapted to urge and lock the leg member and at its opposite side with a hook means for engagement with the top end of the leg member.

Other objects and advantages of the invention will become obvious after considering the detailed discussion of the invention in connection with the preferred embodiment thereof shown in the accompanying drawings in which:

DESCRIPTION OF THE SPECIFIC EMBODIMENT

Figure 1:
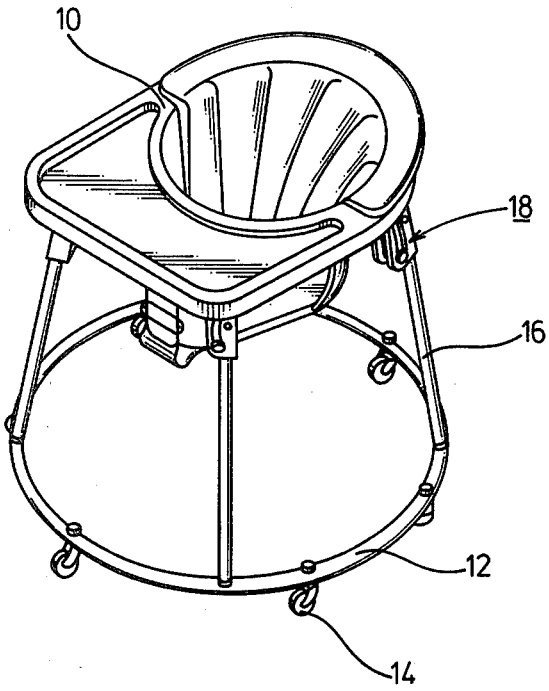
FIG. 1 is a perspective view of the foldable baby walker in accordance with the present invention.
Figure 2:
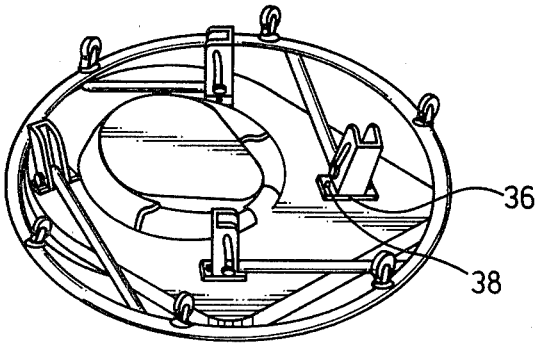
FIG. 2 is a perspective view of the baby walker of FIG. 1 in a folded position.
Figure 3:
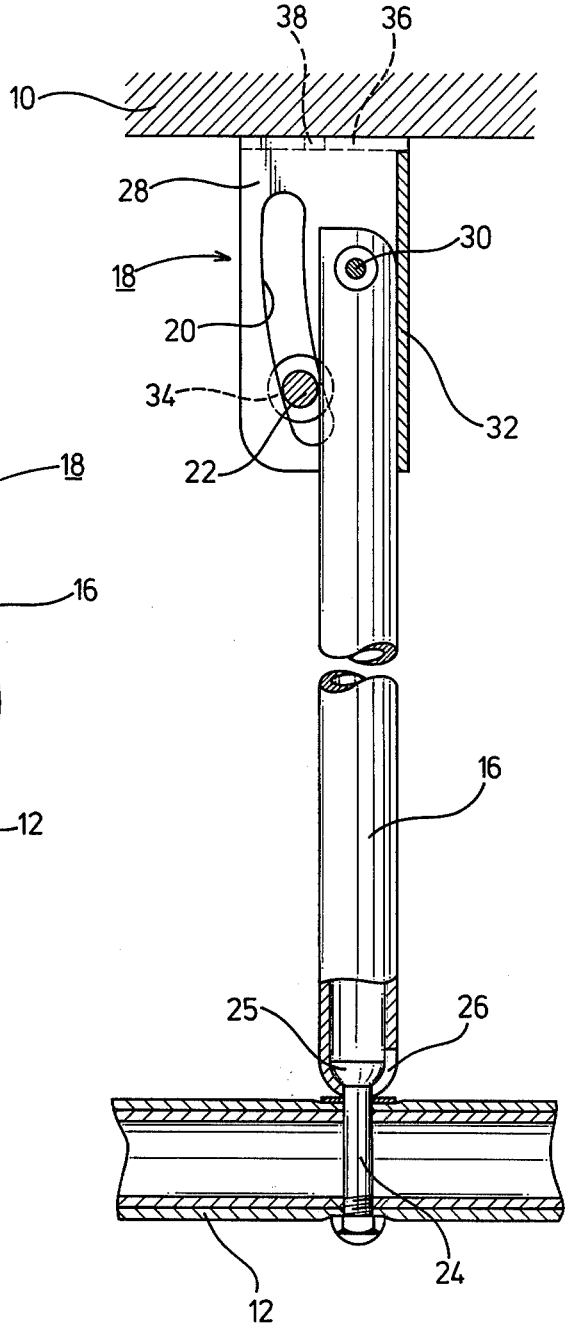
FIG. 3 is a front elevation partially sectioned of the leg member in engagement with the locking member and the annular base frame.
Figure 4:
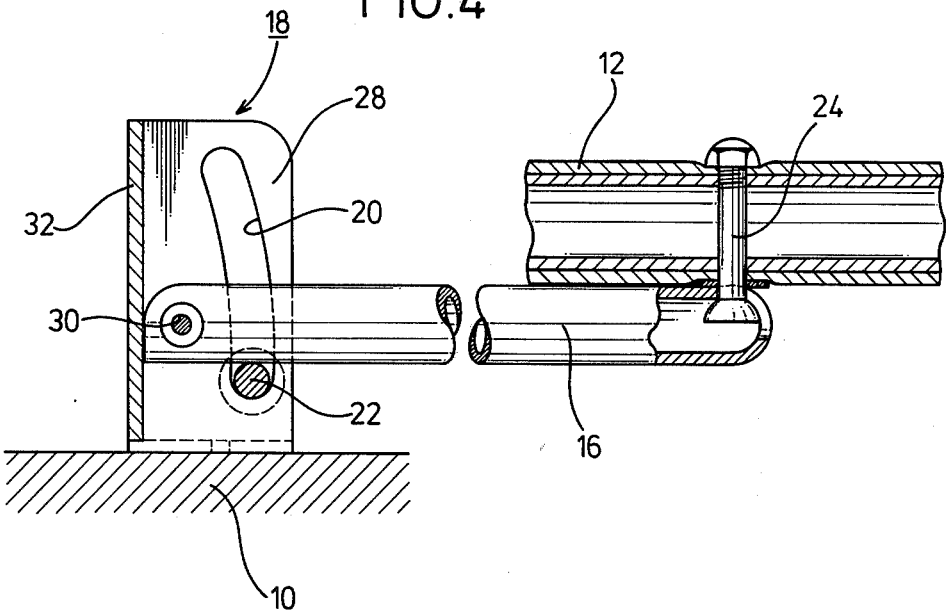
FIG. 4 is a lateral view in partially sectioned of the leg member in the folded position.

FIG. 1 shows a foldable baby walker conveniently provided in accordance with the present invention and comprises a body carrier 10, an annular base frame 12 provided with three or more caster rollers 14 and two or more support legs 16 collapsibly but inseparably connected therebetween by means of a locking means 18. As best shown in FIG. 3 the support leg 16 at its lower end is pivoted to the annular frame 12 whereas the upper end thereof is also pivoted to the body carrier 10 through the locking means 18 which is secured to the rear end of the body carrier 10 and is given an inclined slot 20 through which a slider 22 is slidably provided to urge and lock the upper part of the support leg 16 when it is held in the upstanding position.

The lower end of the support leg 16 is pivotably or turnably connected to the annular frame 12 by means of a flush bolt 24 having a round head 25 with a flat top face.

At the lower end of the support leg 16, there is provided a slot 26 through which the head 25 of the flush bolt 24 is insertable for rotatable engagement. On the other hand, the upper end of the support leg 16 is embraced by and pivoted by a bracket 28 through a pivot pin 30. Movement of the upper end of the support leg 16 is limited by a rear wall 32 of the bracket 28 and locked by the slider 22 when the upper end of the support leg 16 is brought into alignment with the rear wall of the bracket 28 as hereinbefore described so that the support leg 16 will be held in its operative generally erect position on use of the baby walker. The opposite ends of slider 22 are provided with flanges or collars 34 adapted to prevent the slider 22 from disengaging with the inclined slot 20.

The bracket 28 at its one end is provided with horizontally extended seats 36 which are provided with holes 38 for receiving screws not shown.

Figure 5:
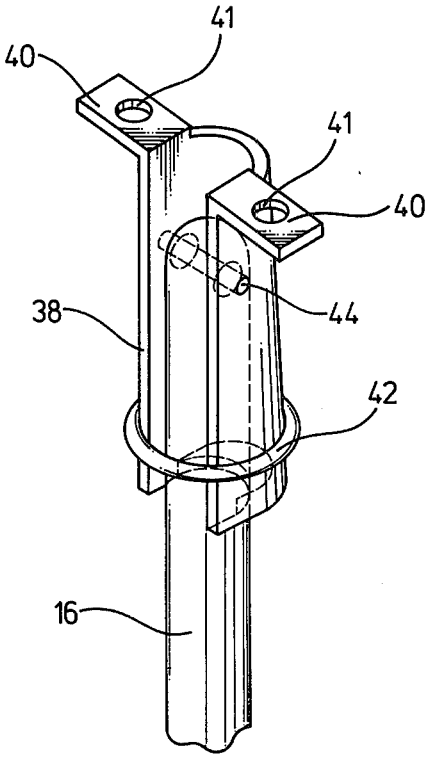
FIG. 5 is a fragmentarily enlarged perspective view of the locking means of another embodiment.
Figure 6:
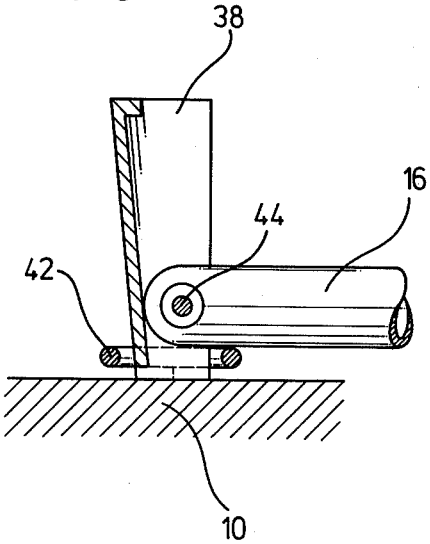
FIG. 6 is a cross sectional view of the locking means of FIG. 5 in the position where the leg member is folded.

In FIGS. 5 and 6, there is illustrated a locking means of another embodiment which comprises a substantially semi-conical or split sleeve 38 with horizontally extended seats 40, 40 having holes 41 for receiving fastening bolts and a clamp ring 42 encircling the sleeve body 38 into which one end of the support leg 16 is pivotably inserted through a pivot 44. When the support leg 16 is aligned with the inner wall of the semi- sleeve 38 the clamp ring 42 slides downwardly until it reaches and is stopped by an enlarged portion of the sleeve 38 so that the support leg 16 is in operative position by the ring 42. When the ring 42 is raised near the seats 40, 40, the support leg 16 may be shifted into the horizontal position as shown in FIG. 6.

Figure 7:
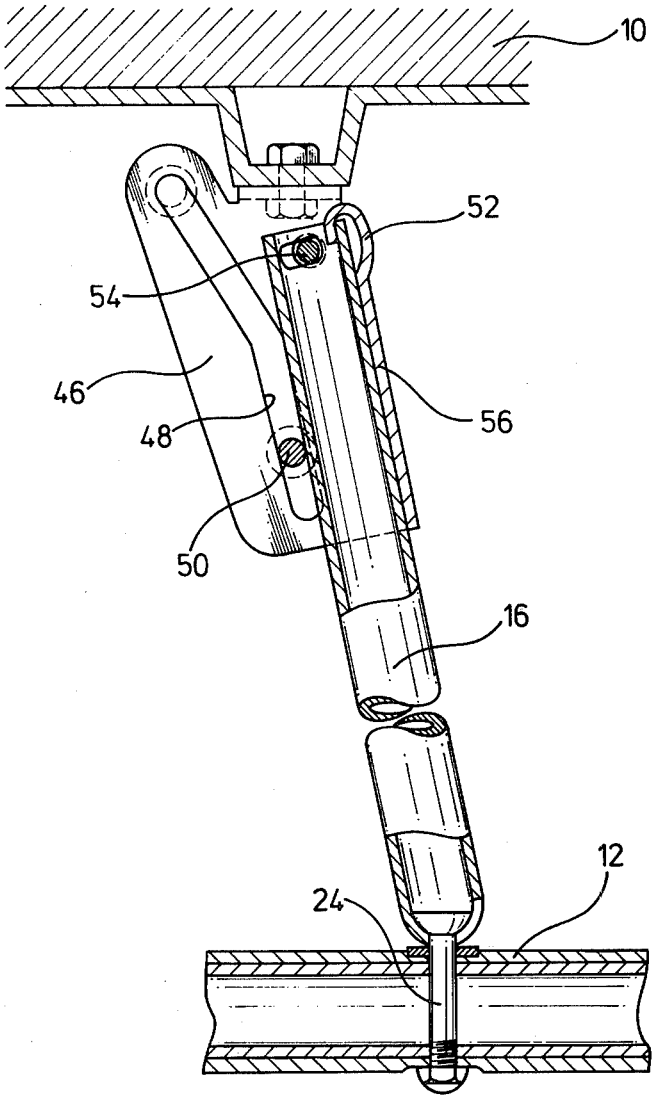
FIG. 7 is a lateral view in partially sectioned of the leg member in engagement with the locking member of another embodiment and the annular base frame.
Figure 8:
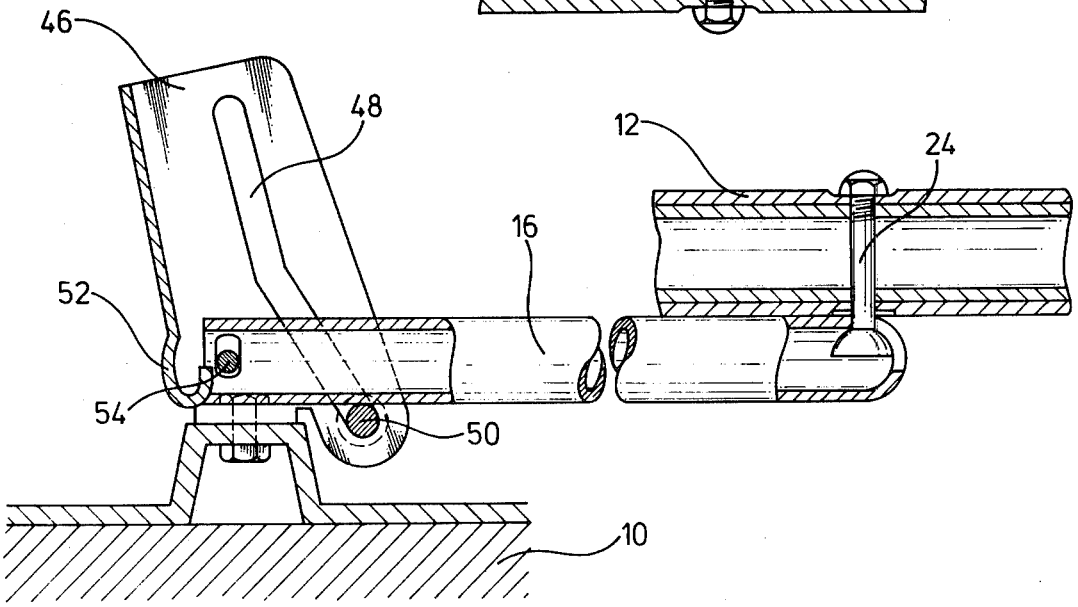
FIG. 8 is a lateral view in partially sectioned of the leg member in the folded position.

In FIGS. 7 and 8, there is illustrated a locking means of a further embodiment which comprises a bracket 46 which is provided adjacent one side thereof with an offset slot 48 for receiving a slider 50 and at its opposed side with a hook means 52 for engagement with the upper end of the support leg 16 which is pivoted to the bracket 46 through a pivot pin 54.

When the upper end of the support leg 16 is in alignment with the rear wall 56 of the bracket 46, the slider 50 slides downwardly until it engages with and is stopped by the circumferential wall of the support leg while the upper end of the support leg is engaged with the hook 52 so that the support leg 16 is firmly held as best shown in FIG. 7. When the slider 50 is moved to the opposite end of the slot 48, the support leg 16 may be shifted to the horizontal position with disengagement of the upper end of the support leg 16 from the hook 52 as best shown in FIG. 8.

As hereinbefore fully described, the baby walker in accordance with the invention may be easily folded with a simple operation and is very convenient for carrying. Further the legs are always held in their upstanding position in a stable manner.

While certain preferred embodiments of the invention have been illustrated by way of example in the drawings and particularly described, it will be understood that various modifications may be made in the constructions and that the invention is no way limited to the embodiments shown.

What is claimed is:

1. A foldable baby walker which comprises a body carrier, an annular base frame having caster rollers and three or more support legs collapsibly but inseparably connected between the body carrier and the annular base frame, each of said support legs being loosely pivoted at its lower end to the annular base frame, and locking means associated with each said support leg secured to the body carrier, each said locking means including a bracket to which said support leg is pivotally connected, said bracket having at least one wall portion against which said support leg abuts for retaining the support leg in its operative uncollapsed condition, a guide surface carried by said bracket at least partially disposed angularly relative to the longitudinal axis of the uncollapsed support leg, and a slide member movably along said guide surface under the influence of gravity to a point where it abuts said support leg and acts as a stop to selectively releasably lock the support leg in its operative uncollapsed condition or permit pivotal movement of the support leg to its collapsed condition when said slide member is moved in a reverse direction along said guide surface.

2. A foldable baby walker as claimed in claim 1, wherein the locking means is provided with an inclined slot defining said guide surface and said slider comprises a pin slidable within said slot.

3. A foldable baby walker as claimed in claim 1, wherein said bracket comprises a substantially conical split sleeve bracket and said slide member is a ring slidable along the exterior surface of said sleeve bracket.

4. A foldable baby walker as claimed in claim 1, wherein said bracket is provided with a slot adjacent one side thereof, said slot defining said guide surface, and with a hook means at the opposed side thereof for engagement with the top end of the support leg to thereby selectively retain the support leg in its operative uncollapsed condition.

* * * * *